US009826817B2

(12) United States Patent
Whitehill

(10) Patent No.: US 9,826,817 B2
(45) Date of Patent: Nov. 28, 2017

(54) CONVERTIBLE, SELF ADJUSTING, MULTIMODAL STRAP SYSTEM FOR CARRYING BAGS AND PACKS

(71) Applicant: Ann Whitehill, Niwot, CO (US)

(72) Inventor: Ann Whitehill, Niwot, CO (US)

( * ) Notice: Subject to any disclaimer, the term of this patent is extended or adjusted under 35 U.S.C. 154(b) by 98 days.

(21) Appl. No.: 14/853,717

(22) Filed: Sep. 14, 2015

(65) Prior Publication Data

US 2016/0183666 A1 Jun. 30, 2016

Related U.S. Application Data

(60) Provisional application No. 62/087,592, filed on Dec. 4, 2014.

(51) Int. Cl.

| | |
|---|---|
| ***A45F 3/04*** | (2006.01) |
| ***A45F 3/14*** | (2006.01) |
| ***A45C 3/00*** | (2006.01) |
| ***A45C 9/00*** | (2006.01) |
| ***A45C 13/30*** | (2006.01) |
| ***A45F 3/02*** | (2006.01) |

(52) U.S. Cl.

CPC ..... *A45F 3/14* (2013.01); *A45C 3/00* (2013.01); *A45C 9/00* (2013.01); *A45C 13/30* (2013.01); *A45F 3/02* (2013.01); *A45F 3/04* (2013.01); *A45C 2009/007* (2013.01); *A45F 3/047* (2013.01); *A45F 2003/142* (2013.01)

(58) Field of Classification Search

CPC ..... A45F 3/14; A45F 2003/142; A45F 3/047
USPC ..... 224/578, 579; 150/108
See application file for complete search history.

(56) References Cited

U.S. PATENT DOCUMENTS 741,098 A * 10/1903 Bibler ..... A45C 13/38 224/260
3,346,155 A * 10/1967 Oechsle ..... A45F 5/12 150/108
3,583,600 A * 6/1971 Scott ..... A45F 5/14 221/185
4,390,116 A * 6/1983 Fehr ..... A45F 5/00 224/258
5,431,317 A * 7/1995 Kliot ..... A45F 3/02 224/153
6,138,881 A * 10/2000 Paul ..... A45F 3/02 224/153
6,152,342 A * 11/2000 Suk ..... A63B 55/408 224/259
6,311,884 B1 * 11/2001 Johnson ..... A45F 3/04 224/153

(Continued)

FOREIGN PATENT DOCUMENTS

WO WO 2016089513 A1 * 6/2016 ..... A45F 3/02

*Primary Examiner* — Justin Larson

(57) ABSTRACT

A multi-mode strap system (100) is convertible between a single arm shoulder bag configuration, a two armed backpack configuration, and a single armed cross body configuration. The strap system (100) includes first and second straps (102 and 104), first and second attachment mechanisms (106 and 108) and a linkage assembly (110). The attachment mechanisms (106 and 108) and linkage assembly (110) allow the straps (102 and 104) to move or slide freely during transitions between the three configurations. The transitions can thus be accomplished without manipulating and straps or buckles and without having to remove the pack, and the pack remains upright during transitions.

14 Claims, 13 Drawing Sheets

(56) References Cited

U.S. PATENT DOCUMENTS

| | | | | |
|---|---|---|---|---|
| 7,059,503 | B2 * | 6/2006 | Andersen | A45F 3/14 224/578 |
| 7,857,181 | B2 * | 12/2010 | Sacks | A45F 3/14 224/578 |
| 8,113,399 | B2 * | 2/2012 | Lee | A45F 3/02 224/578 |
| 8,146,787 | B2 * | 4/2012 | Cragg | A45F 3/02 150/107 |
| 8,231,037 | B2 * | 7/2012 | Sacks | A45C 13/30 224/153 |
| D707,958 | S * | 7/2014 | Rubin | D3/216 |
| 8,844,780 | B2 * | 9/2014 | Hunt | A45C 13/30 224/260 |
| 8,925,772 | B2 * | 1/2015 | Vukovics | A47D 13/02 224/160 |
| 9,198,525 | B2 * | 12/2015 | Wernick | A47D 13/025 |
| D794,110 | S * | 8/2017 | Swaggart | D16/237 |
| 2007/0262105 | A1 * | 11/2007 | Tan | A45F 3/04 224/259 |
| 2009/0205758 | A1 * | 8/2009 | Mankelow | A45C 3/06 150/106 |
| 2012/0223114 | A1 * | 9/2012 | Hunt | A45F 3/14 224/578 |
| 2016/0183666 | A1 * | 6/2016 | Whitehill | A45F 3/02 224/578 |

* cited by examiner

CONVERTIBLE, SELF ADJUSTING, MULTIMODAL STRAP SYSTEM FOR CARRYING BAGS AND PACKS

CROSS-REFERENCE TO RELATED APPLICATION

This application is a non-provisional of U.S. patent application Ser. No. 62/087,592 entitled, "CONVERTIBLE PURSE, CROSS BODY, AND BACKPACK STRAPPING SYSTEM," filed Dec. 4, 2014. The contents of all of the above-noted application is incorporated herein by reference as if set forth in full and priority to this application is claimed to the full extent allowable under U.S. law and regulations.

FIELD OF THE INVENTION

The present invention relates generally to strap systems for carrying bags and packs such as purses, messenger bags, backpacks, sports, medical and industrial equipment carriers and the like and, in particular, to a multimodal strap system that easily converts between three distinct carrying modes; a single arm shoulder bag mode, a two armed backpack mode, and a single armed cross-body style strap system.

BACKGROUND OF THE INVENTION

Carrying bags and packs are used across many industries for a wide variety of purposes including fashion bags and purses, briefcases and messenger bags, luggage, sports and industrial equipment bags, medical first responder bags and cases, to name just a few examples. In this document, the terms bag and pack shall be used interchangeably and refer to a wide variety of carrying bags and pack types that the strap system may be attached to, including, but not limited to, purses, briefcases, messenger bags, sports equipment bags, first responder bags, musical instrument cases, etc.

One useful way of categorizing packs and bags relates to the strap system employed for carrying them. Traditionally, these strap systems have been designed for either single arm carrying or two-arm carrying. In a single arm strap system, the user inserts only one arm through the strap system. The strap system may be pulled over the user's head for cross-body support or simply hung over one shoulder. In either case, the bag or pack generally rests on the user's side. For example, purses, messenger bags, golf bags, and some briefcases or carry-on bags may use this type of strap system. In a two-arm strap system, the user generally places each arm through a separate strap loop. The pack then rests on the user's back. This is often employed for book bags, hiking packs, and other backpacks.

Each type of strap system has its own advantages for certain users in certain contexts. Single arm strap systems can be easily engaged and disengaged from the user's shoulder, and can be accessed, to some extent, without removing the pack. Consequently, these strap systems may be preferred for short trips or where frequent access to the contents of the pack is necessary. Two-arm strap systems are often preferred for ease of carrying, even weight distribution and having the hands free when carrying heavy loads, for longer trips, or where it is desired to keep the pack securely out of the way, e.g., while biking or running through an airport.

However, it is not always the case that a user will only desire to use packs in a single carrying mode. For example, many people use bicycles and motorcycles for commuting or errands. Such users may desire to use a pack with the two-arm strap system while cycling so that the pack remains positioned out of the way on the user's back, but then may wish to have a pack with a single arm strap system for use in the office, at the store, or during other activities. Other users may simply wish to alternate between a single arm strap system and a two-arm strap system depending on the type of activity or length of trips. Because it is often impractical to continually switch contents between separate bags, such users have sometimes attempted to use strap systems in a mode for which it was not intended, e.g., only using a single strap of a two-arm strap system or manipulating a single arm system so that the pack is positioned on the user's back. Misusing the strap systems in these fashion is often uncomfortable or unstable.

Some attempts have been made to provide a strap system for a pack that is convertible between single arm and two-arm carrying modes. For example, bags have been developed that include two separate strap systems for use as desired. Most often however, these depend on extra straps and hardware that increase costs, can be unsightly, and can be troublesome to use (e.g., if the backpack style two-arm strap system is hidden in a pocket when not in use). Moreover, in many cases the pack is disposed in a different orientation depending on which strap system is deployed. Many users would prefer not to carry packs in different orientations, for example, because of the possibility of spilling the contents of pack pockets or containers.

Others have proposed a single strap system that converts between a single arm and a two-arm configuration. However, these have typically required the use and manipulation of specialized parts and hardware, often require taking the bag off of the body to adjust and position the straps relative to the hardware, or have otherwise involved complicated transitions.

For example:

U.S. Pat. No 7,857,181 B2—2010—presents a single strap system that functions in both the single and two-armed configurations. As described in the Operation section of this patent, in order to change from the single to the two arm carrying mode, the user must remove the bag from the body and adjust the straps and then put it on as a backpack.

As will be shown below, my invention is superior in that the user does not have to remove the bag in order to transition between the single arm, shoulder bag configuration and the two armed backpack configuration. My strap system transitions from shoulder bag to backpack by simply inserting the arms through the strap loops, as one would put hands through the sleeves of a shirt, without having to removing the bag. The straps also self-adjust, so the user does not have to manually adjust them.

U.S. Pat. No. 6,311,884 B1—2001—also converts from a back pack configuration to a shoulder configuration, but again it is necessary for the user to take the bag off the body and make adjustments to the straps during transitions. It is also necessary to use a completely separate strap for the shoulder bag configuration. This is both more cumbersome to use and for fashion applications, is very unsightly.

U.S. Pat. No. 9,009,931 B2—2015—describes a solution for securing a messenger bag to the back for stability. Like many designs addressing the load stability of messenger bags, this one employs various complex mechanisms and additional straps for positioning and securing the bag. When secured to the back, the bag is also carried in a diagonal vs. upright position.

My invention is superior in that no additional or specialized parts or extra straps are necessary to secure the pack or bag on the back. Furthermore, when worn in the backpack configuration, my strap system allows the bag to remain in the upright position where the weight is most evenly distributed and the bag or pack and the contents remain upright as well.

SUMMARY OF THE INVENTION

The present invention is directed to a multi-modal strap system that is convertible between 1) a single arm shoulder bag configuration, 2) a two armed backpack configuration, and 3) a single armed cross body configuration.

The strap system is composed of one or more closed loops of leather or other strapping material. In certain embodiments, each strap loop is connected to the next by one or more linkage elements, metal or plastic O rings or rectangular rings for example, that allow the straps to flow smoothly through them. Additional attachment mechanisms of various sizes and shapes, O rings or D rings for example with or without snaps or clasps, can be linked onto the bottom of each strap loop to provide a means of attachment for the strapping system onto the bag or pack to be carried.

The free flowing nature of the straps in relation to one and other, the linkage assemblies, attachment mechanisms and to any pack or bag being carried gives the present invention the unique characteristics that make it superior to previous attempts. In being free flowing, the strap system is able to continually self-adjust in any of the three carrying modes and during the transitions between them, thereby keeping the attached bag and its contents in its upright position as may be desired.

In the first carrying mode, the single armed shoulder bag, the strap assembly receives a first arm of a user and extends over a first shoulder of the user for single shoulder carrying. In the second carrying mode, the backpack configuration, the strap assembly receives first and second arms of the user and extends over first and second shoulders of the user for two shoulder carrying. In the third carrying mode, the cross body bag, the strap assembly receives a first arm of a user and extends over a first shoulder and then the head of the user and comes to position on the second shoulder with the strap resting diagonally across the body.

The transitions between carrying modes can be executed by manipulating only the strap assembly free from operating any other reconfiguration mechanism. In this manner, a user can simply switch between carrying modes as desired without the necessity of operating snaps, buckles, or the like, or even removing the pack. Moreover, such transitions can be accomplished without concern of spilling the bag's contents due to changes in pack orientation. The strap assembly provides comfortable, convenient, balanced, and upright positioning of the pack in each carrying mode.

It will be appreciated that the strap system may be provided as an original component of a pack or as an aftermarket product for use in connection with separately purchased packs.

In certain applications of the strap system it may be useful for the straps to be fixed rather than free flowing and this invention allows for that possibility as well by the simple addition of stitching in the strapping material to hold it in place, or by simple locking mechanisms placed on the straps or linkage or attachment assemblies.

All of the straps may be a continuous fixed length loop, or may be constructed with a length adjustment mechanism that allows the length of each strap loop to be adjustable. When in the single armed, shoulder bag and messenger bag configurations the strap lengths fold flat upon themselves and appear, to the casual observer, as a single strap. In the backpack configuration the straps open up into a figure eight.

This strap system is simple to construct and operate, and can be of simple design that does not detract from the appearance of the pack. The invention encompasses the strap system, any packs and bags incorporating the strap system, and methodology for constructing and using the strap system/pack.

As will be shown in the drawings below, the current invention is a marked improvement upon prior solutions for the following reasons:

1. The current invention is the first that allows for use in, and transition between, three distinct modes—shoulder bag, backpack, and cross-body configurations—with a single strap system that does not require the use of additional straps, buckles, snaps, etc. or any other reconfiguration mechanisms.
2. Unlike the great majority of prior art, the transition of my strap system from the single armed shoulder bag mode to the backpack mode is accomplished by a simple manipulation of the straps while remaining on the wearer's body. As illustrated below in FIGS. 3A-E, beginning with the bag in the shoulder bag mode, the wearer simply inserts each hand through the corresponding strap as one would insert their hands into the sleeves of a shirt or jacket and moves the straps into the backpack position without having to take the bag off.
3. The free flowing strap design allows for any bag or pack type to remain in its upright position in all of the carrying modes unlike many current designs. For example, the typical messenger bag hangs in its upright position while it is in the shoulder bag or cross body configuration, but when put on the back for travel, the bag is typically in a horizontal position and requires additional straps, buckles, clasps and such to hold it securely on the back.
4. Many of the most common messenger bag designs do not have any provisions for secure carrying while the bag is on the back. When being carried on a bicycle or motorcycle, these bags typically slide around to the front of the rider and flap back and forth against the rider in the front. This is a common annoyance with most messenger bags and, more importantly, can be very dangerous as the weight shifts.

These innovations provide significant advantages in the following ways.

1. Safety—The current invention solves the main problem of many messenger type bags in that it prevents the bag from slipping to the front of the body while on a bicycle or motorcycle which can cause the rider to become distracted, uncomfortable, and possibly unbalanced.
2. Production cost savings due to simplicity of the design and the lack of specialized parts or additional straps or hardware.
3. The simplicity and elegance of the design lend themselves to many high fashion applications where current solutions are deemed too unattractive to be used.

In accordance with one aspect of the present invention, a convertible strap system is provided. The system includes a strap assembly consisting of one or more straps of material and first and second attachment mechanisms for attaching the strap assembly to the pack or bag at first and second pack attachment locations. One or more linkage assemblies, interconnected to the strap assembly between the first and second attachment reconfigurations, allow the strap assembly to be configured in single arm or two arm configurations, e.g., in three distinct carrying modes—single armed shoulder bag mode, backpack mode, and cross body bag mode.

The first strap extends through the first attachment mechanism and the linkage mechanism and is freely moveable relative to the first attachment mechanism and linkage mechanism so as to transition between the one arm and two arm configurations. Similarly, the second strap extends through the second attachment mechanism and the linkage mechanism and is freely moveable relative to the second attachment mechanism and the linkage mechanism for such transitions. Each of the attachment mechanisms and the linkage assembly includes one or more loops of material, e.g., a metal, a plastic, or other smooth ring, through which the straps can slide. The linkage assembly may include a single loop of material or multiple loops to accommodate different designs or carrying configurations.

In accordance with another aspect of the present invention, a pack or bag with a convertible strap system is provided. The pack or bag includes a pack body having at least one internal compartment accessible via an opening disposed at a top portion of the compartment when the pack is in an upright orientation. For example, the opening may be provided at or near the top of the pack and may extend across the entirety or only a portion of the pack width. The opening may be enclosed by a zipper, flap, or the like or may be left open. The pack further includes first and second straps each formed from a loop of material. First and second securing mechanisms are provided for securing the respective first and second straps to the pack body at first and second securing locations. Each of the securing mechanisms may be formed from one or more loops of material such as a ring formed from metal, plastic, or other material. The securing mechanisms may also serve to attach the straps to the pack body. The first and second securing locations are disposed above a horizontal centerline of the pack body when the pack is in the upright orientation and the attachment locations are disposed on opposite sides of a vertical centerline of the pack body. A linkage mechanism is provided for interconnecting the first and second straps. The linkage mechanism is formed from one or more loops of material such as ring formed from metal, plastic, or other material.

The strap system is configured to be self—adjusting such that the pack remains in an upright orientation in each of the three carrying modes, shoulder bag, backpack, and cross body. In addition, the first and second attachment mechanisms and linkage assembly remain continuously attached to the strap assembly throughout transitions between the three modes. Moreover, the transitions between carrying modes can be executed by manipulating only the strap assembly free from operating any other reconfiguration mechanism. In this manner, a user can simply switch between carrying modes as desired without the necessity of operating snaps, buckles, or the like, or even removing the pack. Moreover, such transitions can be accomplished without concern of spilling the bag's contents due to changes in pack orientation. The strap assembly provides comfortable, balanced, and convenient positioning of the pack in each carrying mode. It will be appreciated that the strap system may be provided as an original component of a pack or as an aftermarket product for use in connection with separately purchased packs.

In the first carrying mode, the shoulder bag, the strap assembly receives a first arm of a user and extends over a first shoulder of the user for single shoulder carrying. In the second carrying mode, the backpack mode, the strap assembly receives first and second arms of the user and extends over first and second shoulders of the user for two shoulder carrying. In the third carrying mode, the cross body or messenger bag mode, the strap assembly is placed over the wearer's first shoulder and head and comes to rest on the second shoulder of the user with the bag resting on the opposite side.

In accordance with a still further aspect of the present invention, a method is provided for using a pack including a convertible strap system. The method involves providing a pack including a pack body. In certain embodiments the pack body has at least one internal compartment accessible via an opening disposed at the top portion of the compartment. The pack further includes a strap assembly having one or more straps of material and first and second attachment mechanisms for attaching the strap assembly to the pack. The methodology includes using the pack in a first carrying mode by forming a single opening from the strap assembly, and inserting a first arm of a user through the single opening such that the strap mechanism extends over a first shoulder of the user and the pack is in an upright orientation. The methodology further includes using the pack in a second carrying mode by forming first and second openings from the strap assembly and inserting the first arm of the user through the first opening of the strap assembly such that the first strap extends over the first shoulder of the user and inserting a second arm through the second opening of the strap assembly such that the second strap extends over a second shoulder of the user and pack is in an upright orientation. A third carrying mode is accomplished by forming a single opening from the strap assembly, and inserting a first arm and the head of a user through the single opening of the strap assembly and bringing the strap to rest on the opposing shoulder in a cross body configuration.

BRIEF DESCRIPTION OF THE DRAWINGS

For a more complete understanding of the present invention and further advantages thereof, reference is now made to the following detailed description taking in conjunction with the drawings, in which.

DETAILED DESCRIPTION

In the following description, a number of embodiments of the invention are described. These embodiments collectively illustrate various aspects of the invention. It will be understood that many other embodiments and implementations of the invention are possible. Accordingly, the description below should be understood as exemplifying the invention and not by way of limitation. For example, it will be understood that various other shapes, styles, and configurations of the pack are possible and that many other shapes, dimensions, materials, and configurations of the convertible strap system are also possible.

Figure 1A:
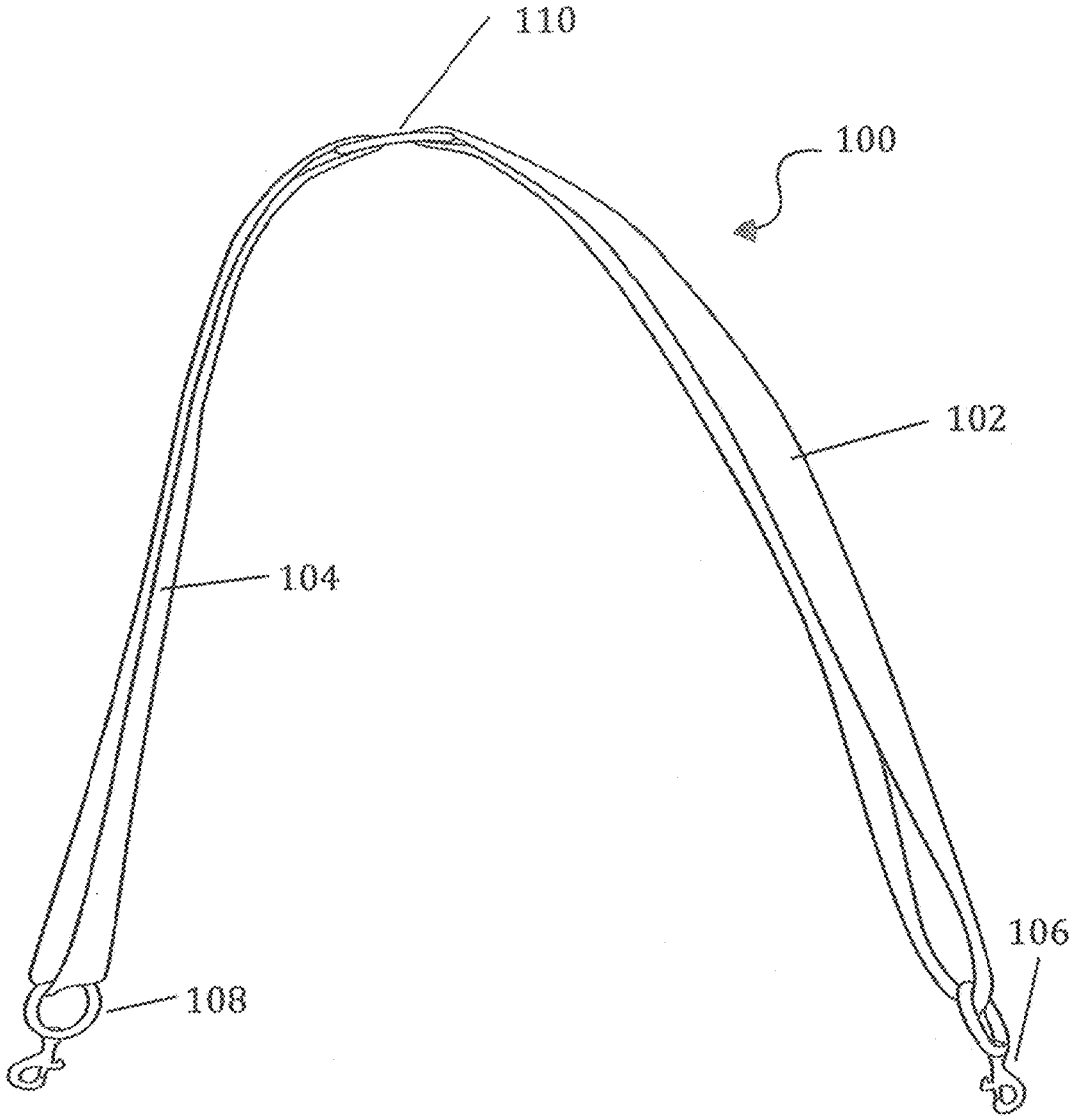
FIG. 1A is a perspective view of the present invention shown in the single arm, shoulder or cross-body carrying mode.

Referring to FIG. 1A, a perspective view of a strap system 100 in accordance with the present invention is shown. The strap system 100 includes first and second straps 102 and 104. In the illustrated embodiment, each of the straps 102 or 104 is formed as a continuous loop of material such as leather, vinyl, or fabric. For example, each of the straps 102 and 104 may be formed from a strip of leather sewn or otherwise attached together at the ends thereof to form a continuous loop. It is also possible for the strap loops 102 and 104 to be constructed with a strap length adjustment mechanism as will be show in FIG. 1B. The illustrated strap system 100 further includes first and second attachment mechanisms 106 and 108 and a linkage assembly 110. The attachment mechanisms 106 and 108 are used to attach the strap system 100 to a pack or bag as will be described in more detail below. Each of the attachment mechanisms 106 and 108 may be comprised of an almost limitless variety of combinations of snaps, loops, clasps and other pieces, including one or more loops of material. In this example attachment mechanisms 106 and 108 are O-ring swivel snap hooks, but an endless variety of attachments are possible, several of which will be illustrated in later drawings.

Preferably, each of the attachment mechanisms 106 and 108 allows a corresponding strap 102 or 104 to move or slide freely therethrough during transitions between the three carrying modes—shoulder bag, backpack, and cross body bag, as will be described in more detail below. In this regard, each of the attachment mechanisms 106 and 108 may include a smooth ring of a variety of shapes, D rings, O-rings, or rectangular rings for example, formed from metal, plastic, or other suitable material. The straps 102 and 104 may be threaded through the ring before the ends of the straps 102 and 104 are connected to form a strap loop, or attachment mechanisms 106 and 108 may be constructed in a manner that allows them to be attached to the strap loops 102 and 104 after they are formed into a loop.

Where the strap system 100 is provided as an aftermarket product for attachment to a separately purchased pack, the attachment mechanisms 106 and 108 may be adapted for such interconnection. For example, the attachment mechanisms 106 and 108 may include a ring formed from helically wound material, like a key chain, such that the ring can receive attachment structure of a pack. Alternatively, the attachment mechanisms 106 and 108 may include a ring that opens like a jewelry clasp to receive attachment structure of a pack. As a still further alternative, a separate strap of material or ring may be provided as part of the attachment mechanisms 106 and 108 to interconnect a ring of the attachment mechanisms 106 and 108 to attachment structure of a pack. Many other connection options are possible.

Figure 1B:
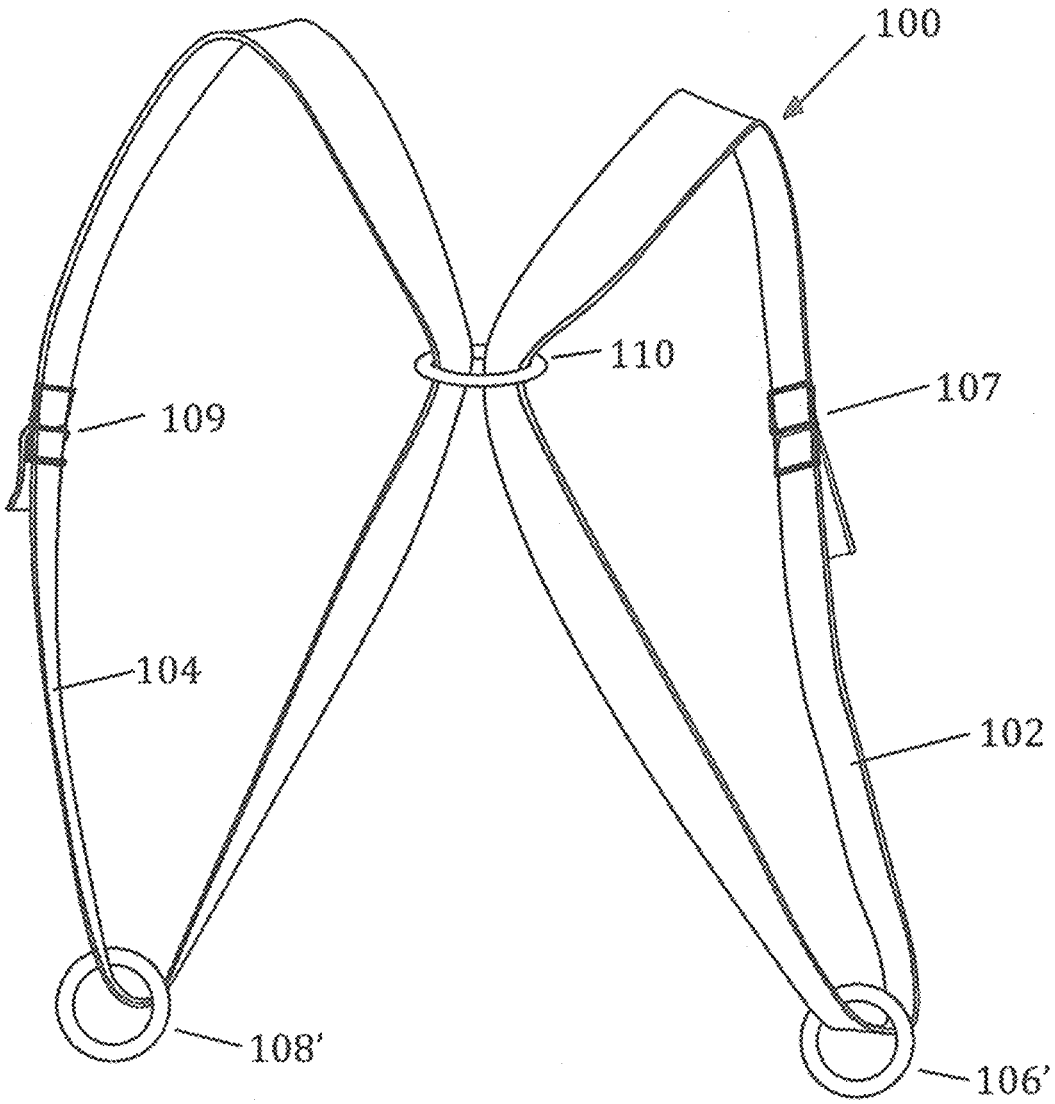
FIG. 1B is a perspective view showing the convertible strap system of FIG. 1A expanded into the two armed backpack mode.

FIG. 1B illustrates the strapping system 100 of FIG. 1A expanded into the two armed backpack carrying mode. Also shown are strap adjustment mechanisms 107 and 109, in this case, slide buckles that may be incorporated into the strap systems 100 and 200 as needed.

Figure 2A:
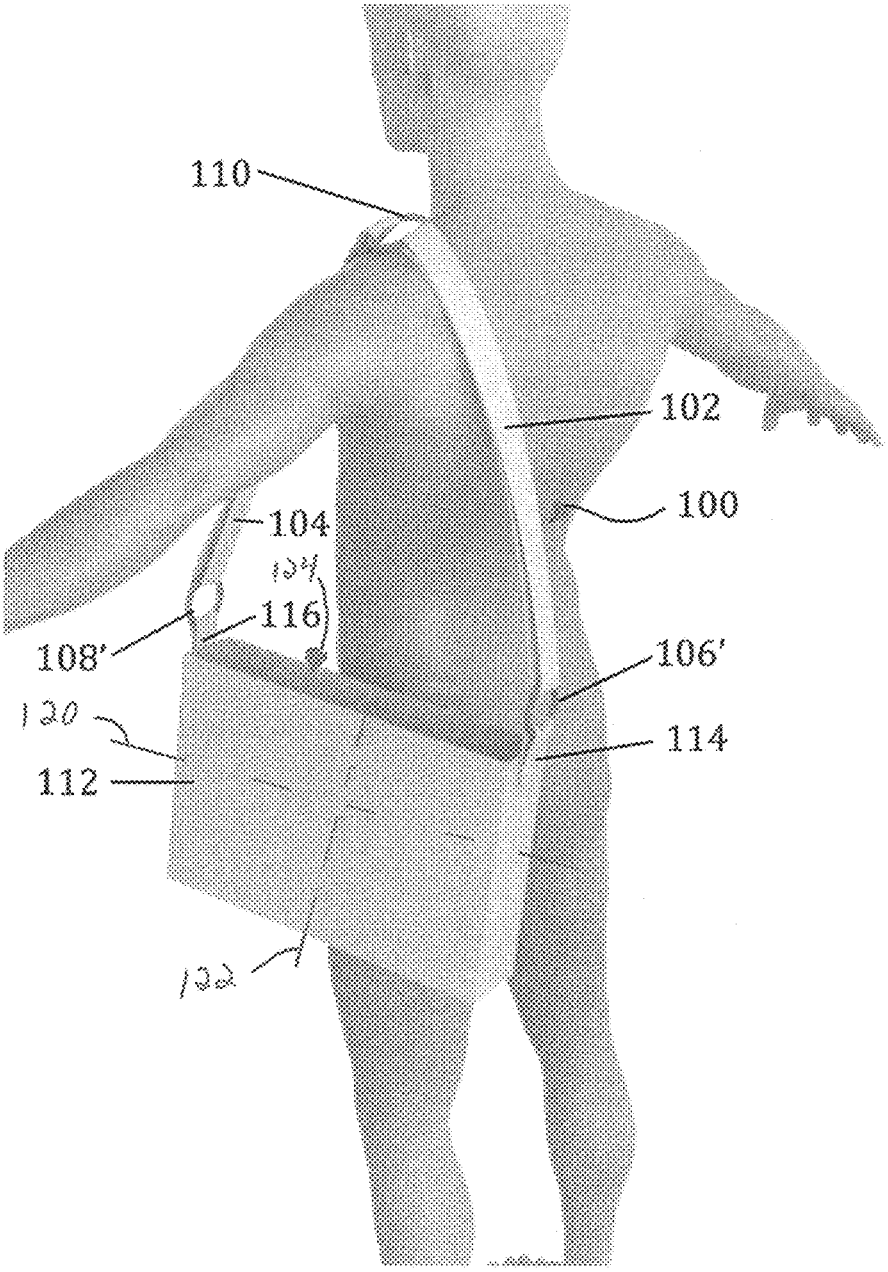
FIG. 2A is a perspective view showing the convertible strap system of FIG. 1A connected to a pack in the one armed, shoulder bag configuration.

FIG. 2A illustrates the strap system 100 of FIG. 1A attached to a pack 112. The pack 112 may be any type of pack, either provided together with the strap system or separately purchased by the user such as a purse, a messenger bag, a book bag, an item of luggage, a brief case, a computer bag, a tote, or the like. The illustrated pack 112 includes conventional attachment structures 114 and 116. For purposes of illustration the attachment structures 114 and 116 are shown as loops of leather disposed at the upper corners of the pack 112. However, it will be appreciated that the strap system 100 can be attached to a variety of types of attachment structures 114 and 116.

It will be appreciated that the rings of the attachment mechanisms 106' and 108' and of the attachment structures 114 and 116 may be directly interconnected as shown, or they may be connected by a variety of combinations of strap loops and ring or other connecting combinations.

The attachment mechanisms 106' and 108' are preferably disposed on the pack 112 at locations above a horizontal centerline 210 of the pack 112 when the pack is in an upright position as illustrated. In this manner, the center of mass of the pack 112 will generally be below the attachment locations so that the pack hangs stably when the pack 112 is lifted using the strap system 100. In addition, the attachment locations of the attachment structures 114 are preferably disposed on opposite sides of a vertical centerline 122 of the pack 112. It will thus be appreciated that there is significant flexibility in positioning the attachment structures 114 so as to accommodate various aesthetic and structural objectives. It will be appreciated that the strap system 100 may be attached to the pack 112 at other locations (e.g., below horizontal centerline 120) and a separate securing mechanism, such as a loop of material above the horizontal centerline 120, may be used to secure the straps in a secure position. In the illustrated embodiment, the attachment structures 114 are disposed at upper corner portions of the pack 112, e.g., at or adjacent to the corners of the pack 112.

The size and configuration of the pack 112 may be varied depending on the intended use of the pack and other design considerations. For example, the pack 112 may be a purse, briefcase, computer bag, item of luggage, book bag, or other type of pack. The pack 112 may include a single internal compartment 218 or multiple internal compartments. The compartment(s) may extend substantially across the full width and height of the pack 112 or only a portion thereof. In the illustrated embodiment, the pack 112 is a multipurpose pack and may include internal compartments for holding a standard laptop computer as well as pockets for holding pens, pencils, business cards, and other items.

The illustrated pack 112 includes at least one internal compartment having an opening 124 at a top end thereof. The opening 124 may be covered by a flap that can be opened to access the compartment. It will be appreciated that the opening 124 may alternatively be closed by a zipper or other mechanism or left open. The pack 112 can be maintained in an upright position in any carrying mode and throughout transitions therebetween. Consequently, there is reduced concern about spilling items from the opening 124 during use even if the opening 124 is not secured. The pack 112 may further include external pockets for easy access.

It will be appreciated that the size, shape, configuration, and materials used for constructing the pack 112 may be varied depending on the intended use of the pack 112 and other design considerations. In the illustrated embodiment, the pack 112 and the straps of the strap system 100 are formed primarily from leather. The attachment mechanisms 106' and 108' and the linkage assembly 110 are formed from suitably sized metal rings. The pack 112 has a width and height suitable to carry standard laptop computers. In this regard, the width of the pack is preferably at least about 14 inches and more preferably at least about 17 inches. The height of the pack 112 is preferably at least about 10 inches and more preferably at least about 12 inches. The thickness in the illustrated pack 112 is preferably between 1 and 10 inches, for example, between about 2 inches and 5 inches.

The strap system 100 in the illustrated embodiment is formed from two straps 102 and 104 formed as loops of material. Each of the straps 102 and 104 preferably has a total length of between about 30 and 50 inches, for example, between about 38 and 42 inches. This strap dimension has been found to provide comfortable positioning of the pack 112 in each carrying mode as well easy transitions therebetween. The illustrated straps have a width of between 1 to 2 inches, for example, about 1.5 inches.

The attachment mechanisms 106' and 108' and the linkage assembly 110 are dimensioned and designed to allow the straps 102 and 104 to move freely during transitions as described below. In this regard, the attachment mechanisms 106' and 108' and the linkage assembly 110 preferably have a dimension that is at least equal to and, preferably, slightly greater than the width of the straps 102 and 104. For example, each of the attachment mechanisms 106' and 108' and the linkage assembly 110 may have an internal opening dimension of about 1¾ inches.

Figure 2B:
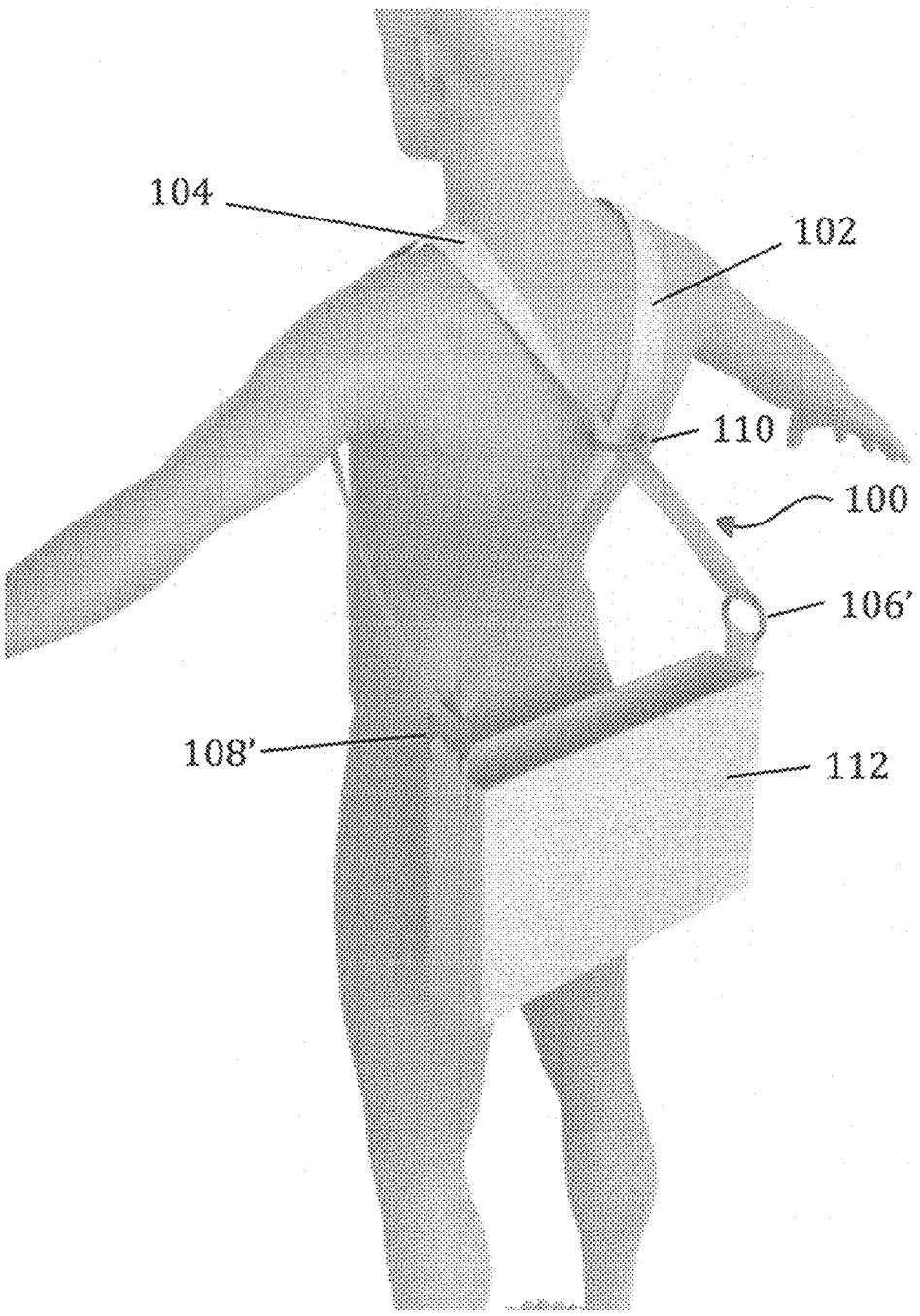
FIG. 2B is a perspective view showing the convertible strap system of FIG. 1A expanded into the backpack configuration as in FIG. 1B and connected to a pack.

FIG. 2B illustrates the strap system 100 from FIG. 1B connected to a pack.

Figure 2C:
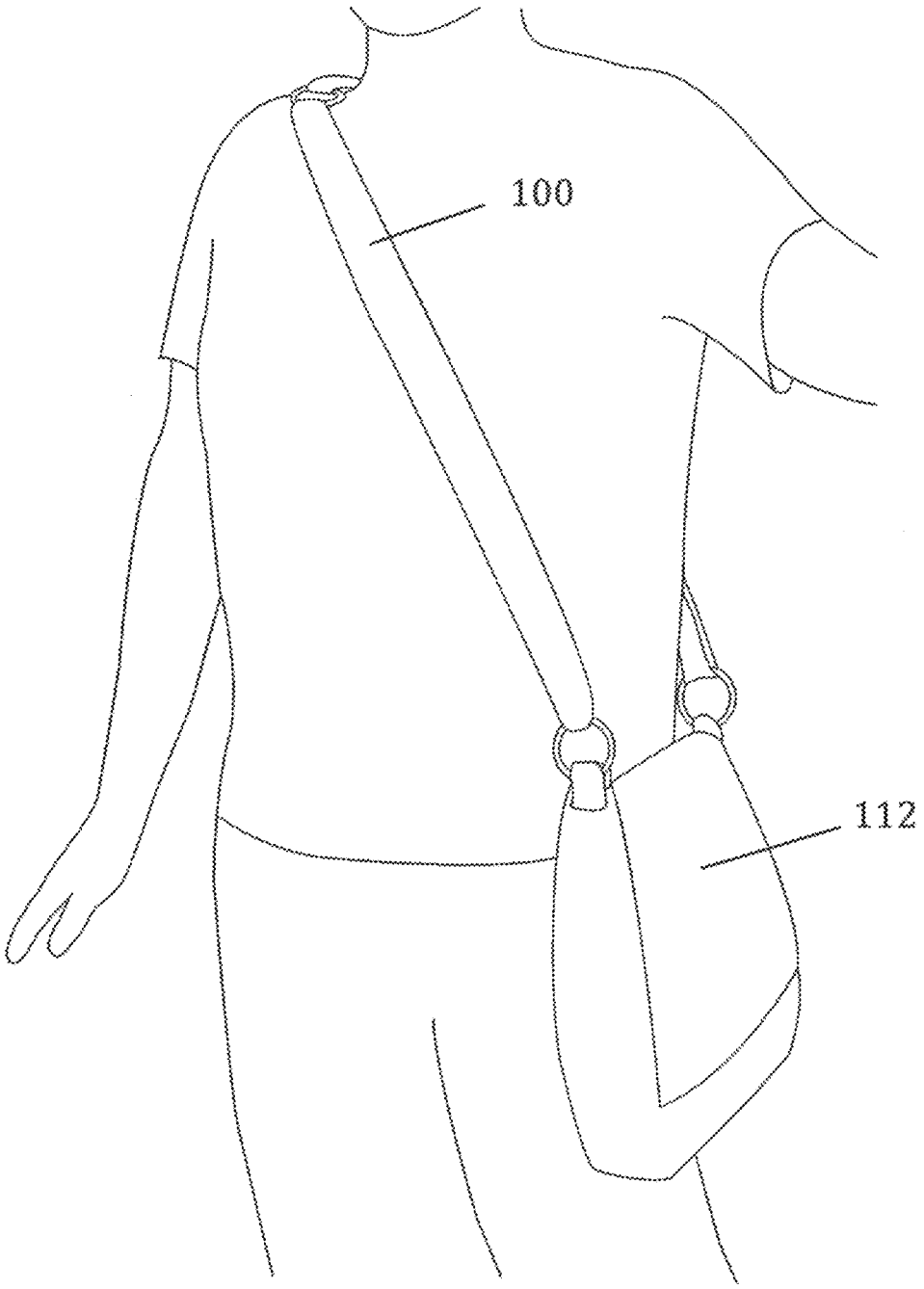
FIG. 2C is a perspective view showing the convertible strap system of FIG. 1A connected to a pack in the one armed, cross body bag configuration.

FIG. 2C illustrates the strap system 100 from FIG. 1A connected to a pack 112 worn in the cross body, messenger bag position.

Figure 3A:
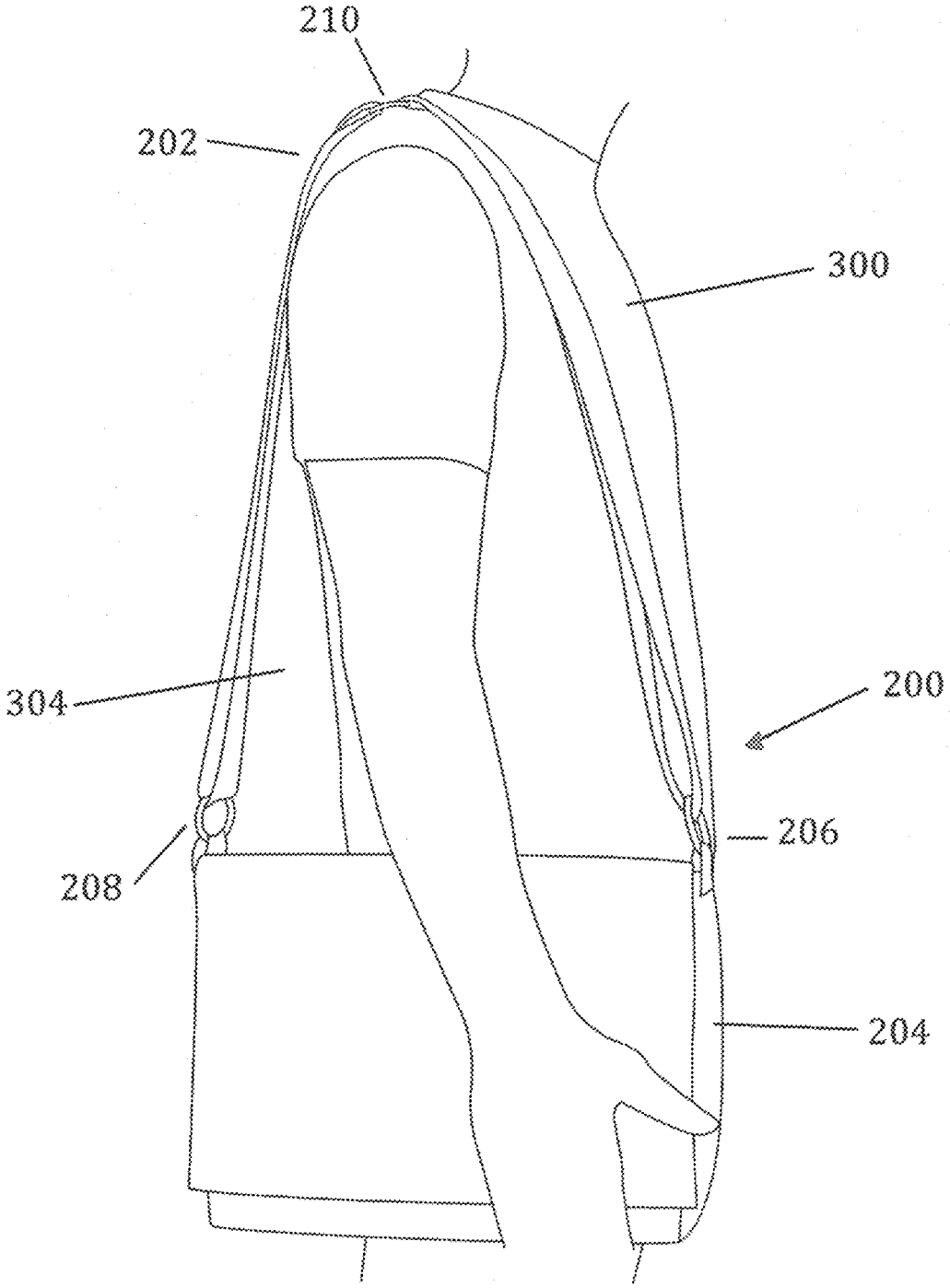
FIGS. 3A-3E are perspective views illustrating transitions between carrying modes using the pack of FIG. 2.

FIGS. 3A-3E illustrate certain carrying modes of the pack of FIG. 2 as well as a process for transitions therebetween. FIG. 3A shows a user 300 using the pack 200 in a single arm carrying mode. In this mode, the strap system 202 defines a single opening 304, the user inserts one arm through the opening 304 so that the strap system 202 rests on the user's shoulder. In this carrying mode, the pack body 204 rests comfortably against the user's side, for example, against the user's hip depending on the length of the strap system 202.

Figure 3B:
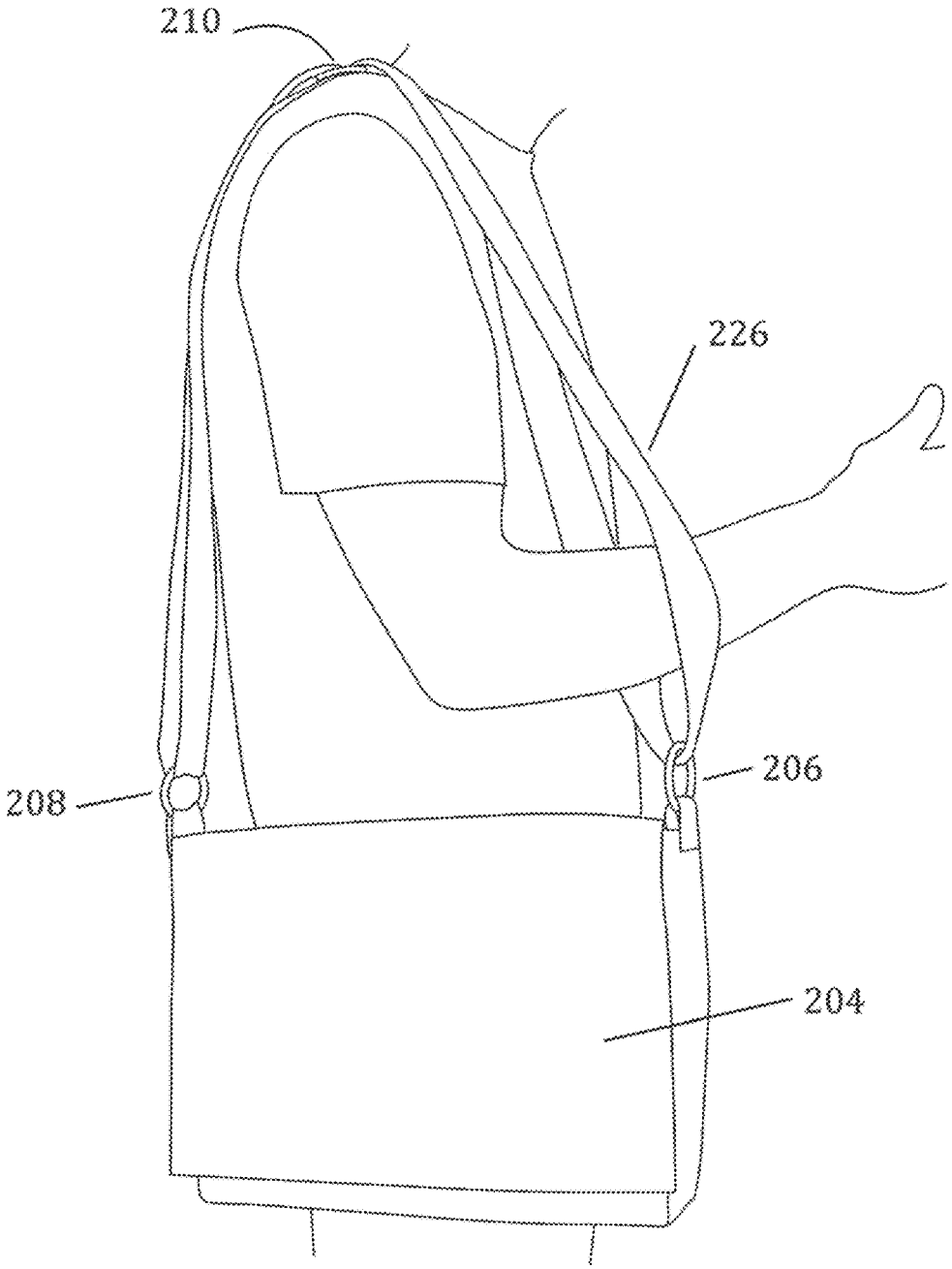
Figure 3C:
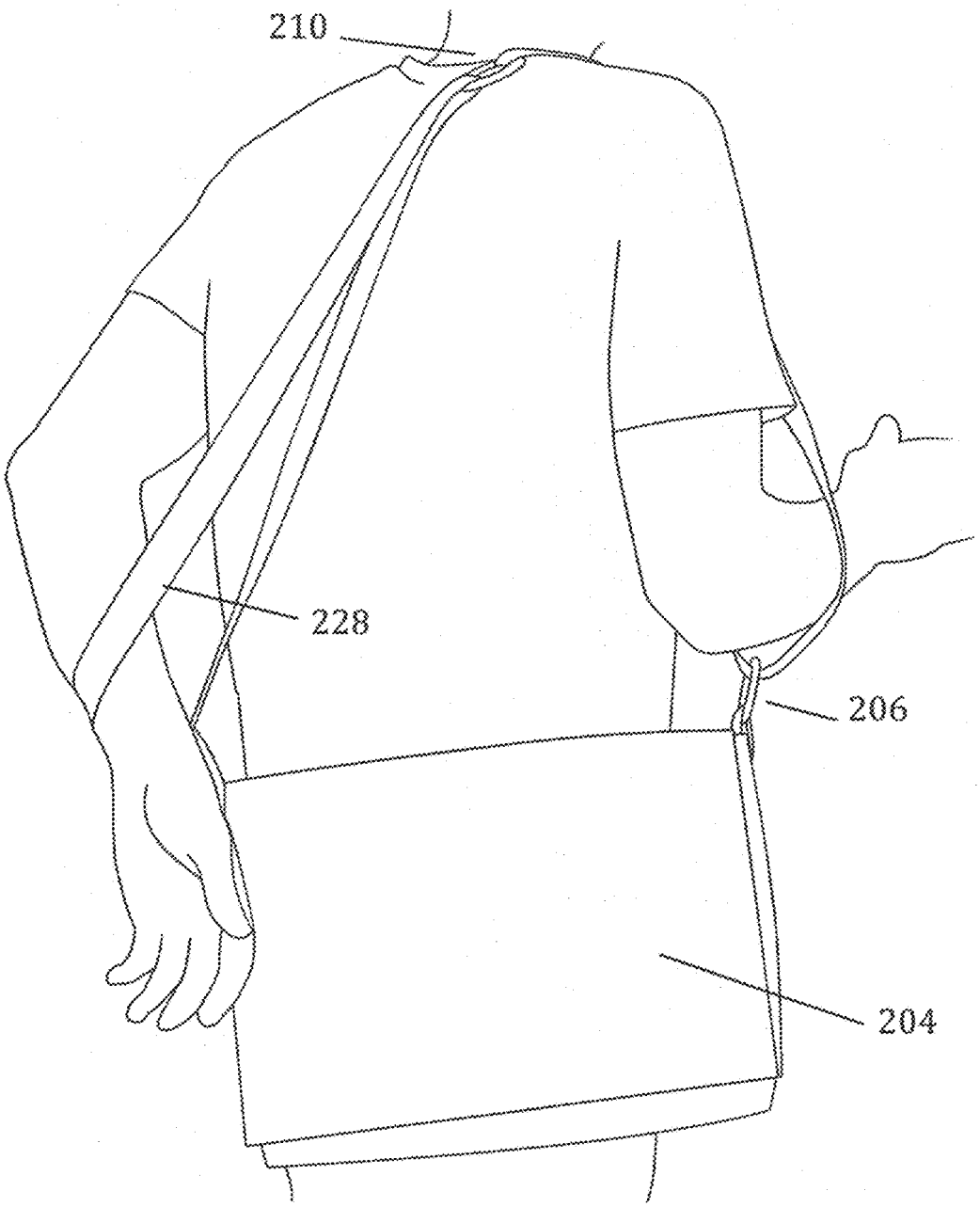
Figure 3D:
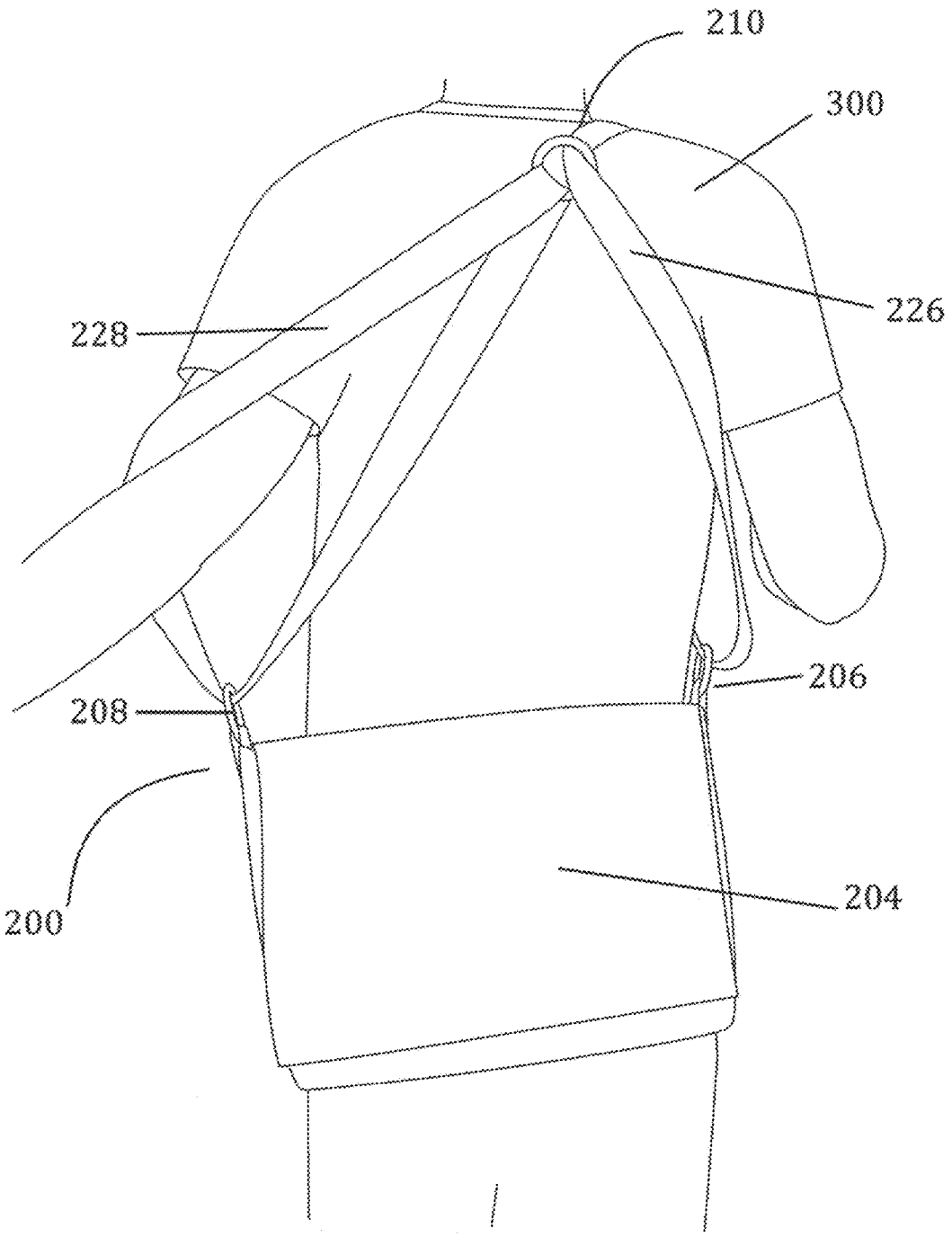
Figure 3E:
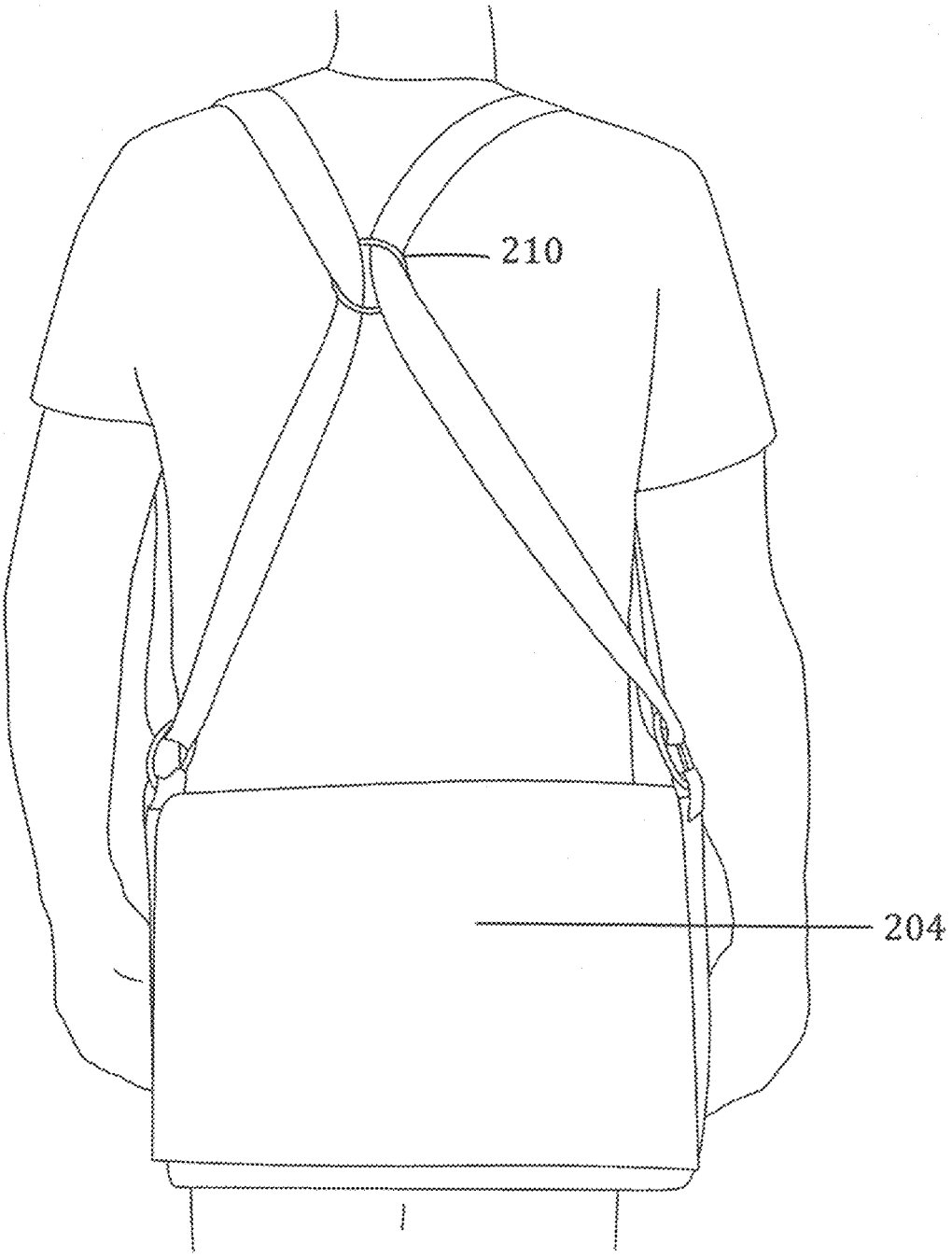

To initiate a transition from the single arm carrying mode of FIG. 3A to a two-arm carrying mode, the user can insert an arm through a loop formed by a first strap 226 as shown in FIG. 3B. Next, the user can insert his or her other arm through the loop formed by the other strap 228 as shown in FIG. 3C. The user 300 can then pull each of the straps 226 and 228 over his or her shoulders (see FIG. 3D) until the pack 200 is disposed in the two-arm configuration as shown in FIG. 3E. Ideally, the linkage mechanism 210 is disposed substantially at the center of the user's back in the two-arm carrying configuration and pack body 204 is stably centered on the user's back. This process can simply be reversed to transition from the two-arm carrying configuration of FIG. 3E back to the single arm carrying configuration of FIG. 3A.

A few advantageous features of the invention can be noted in relation to the drawings of FIGS. 3A-3E. First, the transition between carrying configurations can be accomplished without manipulating any snaps, buckles, or other attachment mechanisms. Rather, the user 300 simply manipulates the straps 226 and 228. The straps 226 and 228 are continuously connected to the connection mechanisms 206 and 208 as well the linkage assembly 210 throughout the transitions and the straps 226 and 228 simply slide in relation to the connection mechanisms 206 and 208 and linkage assembly 210. In addition, the pack 200 remains in an upright position in each of the carrying configurations as well as throughout the transition there between. Accordingly, there is reduced concern about movement or spillage of the contents of the pack 200. Moreover, it is not necessary for the user 300 to set the pack 200 down in order to accomplish a transition between the carrying modes. Rather, the pack 200 can remain supported by at least one shoulder of the user 300 throughout the process. Accordingly, transitioning between carrying modes is simple, convenient, and can be accomplished without concern that the pack will get dirty, wet, or otherwise damaged due to having to set the pack down.

Figure 4A:
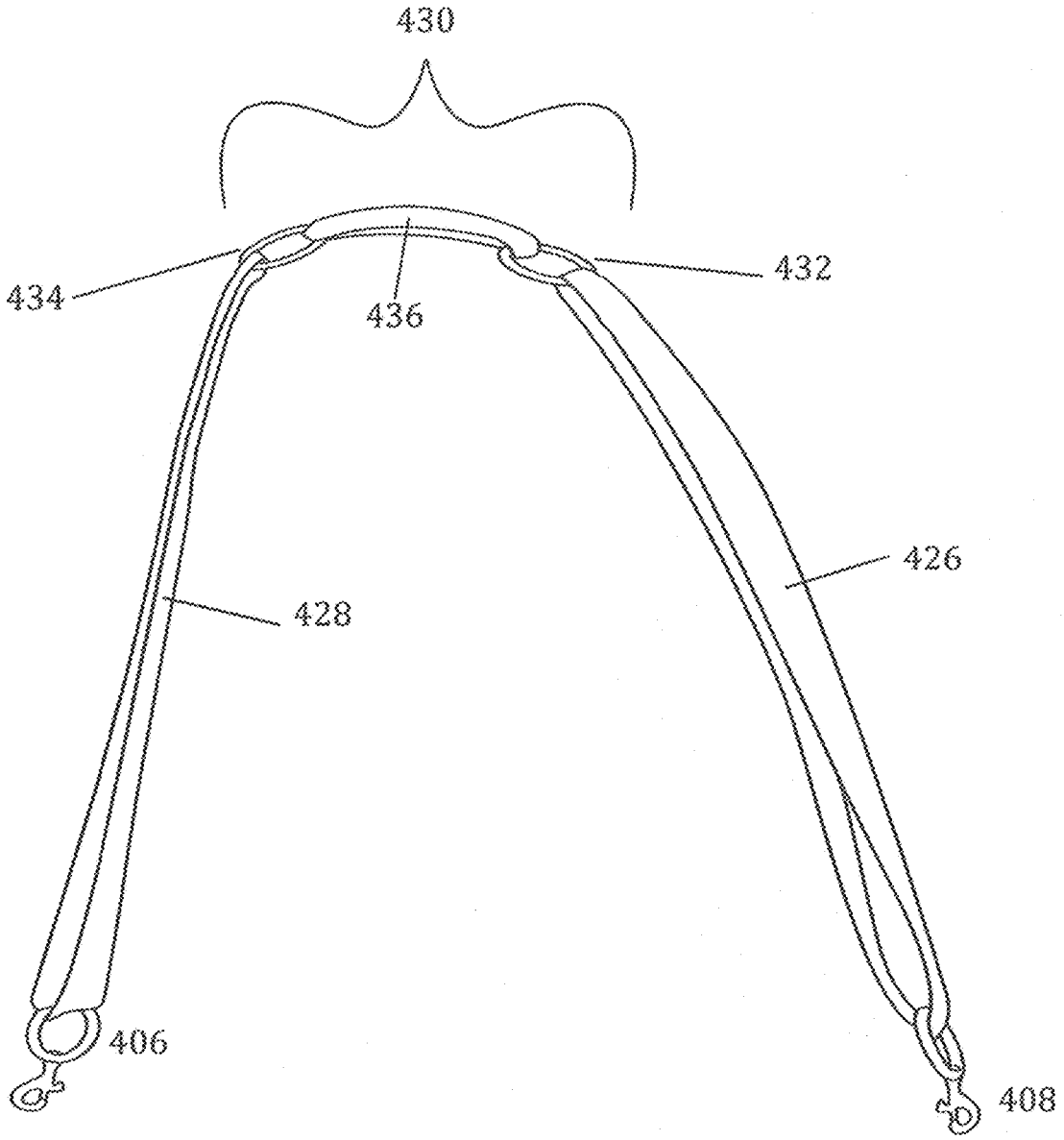
FIGS. 4A-4C illustrate a pack incorporating a convertible strap system in accordance with an alternative embodiment of the present invention.
Figure 4B:
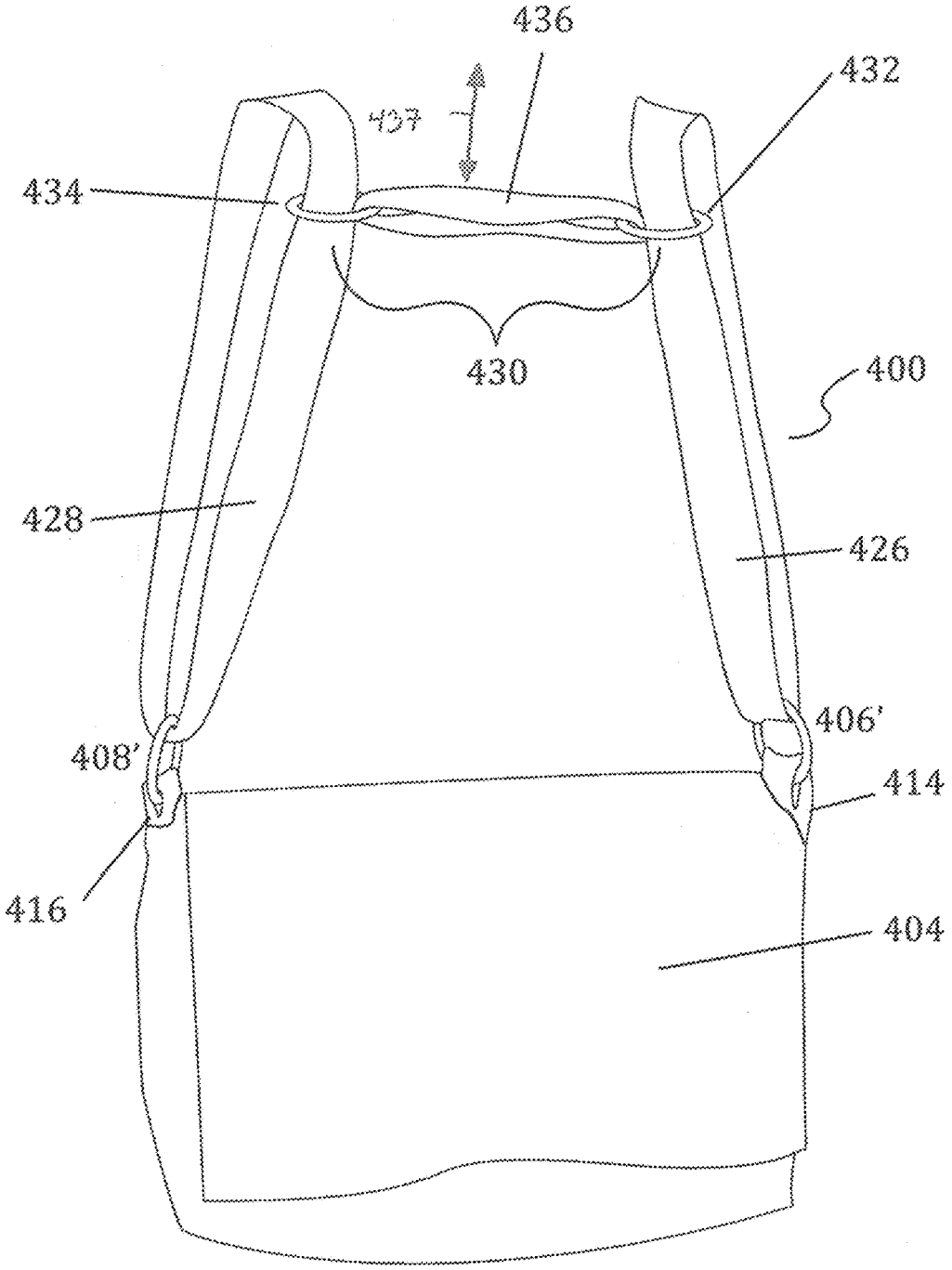

FIGS. 4A-4B show an alternative embodiment of a pack 400 in accordance with the present invention in the single arm carrying configuration and the two-arm carrying configuration, respectively. The illustrated pack 400 includes a pack body 404, attachment structures 414 and 416 attachment mechanisms 406 and 408, (with alternate mechanisms 406' and 408' shown in FIG. 4B) and straps 426 and 428 which can all be constructed generally as described above in connection with FIG. 2 (though the length of the straps 426 and 428 may be varied in relation to the embodiment of FIG. 2).

However, the illustrated pack 400 includes a different linkage assembly 430 for connecting the straps 426 and 428. In particular, the illustrated linkage assembly 430 includes first and second rings 432 and 434 and a linkage strap 436. Such a linkage assembly 430 may be desired for aesthetic and/or structural reasons. For example, the illustrated linkage assembly 430 can be used to accommodate different positioning of the pack body 404 on the user in one or both of the carrying modes in relation to the design of FIG. 2. For example, by appropriate selection of the lengths of the straps 426, 428, and 436, the pack body 404 can ride higher or lower on the user's back or side in the one arm and/or two-arm carrying modes. As shown in FIG. 4B, in the two-arm carrying configuration, the vertical position of the pack body 404 on the user's back is determined by the length of the straps 426 and 428 (which are preferably of equal length), whereas the position of the pack body 404 in the single arm carrying configuration depends not only on the lengths of the straps 426 and 428, but also depends on the length of the strap 436. In this regard, if the strap 436 is sufficiently long so that it is not in significant tension in the two-arm carrying mode, the strap 436 can be easily moved up or down, as shown by arrow 437, as may be desired for aesthetics or to get the strap 436 out of the way. Moreover, the design of FIGS. 4A-4B can assist in spreading the weight of the pack 400 on the user's back or provide a more comfortable handle for carrying the pack 400 by hand.

Figure 4C:
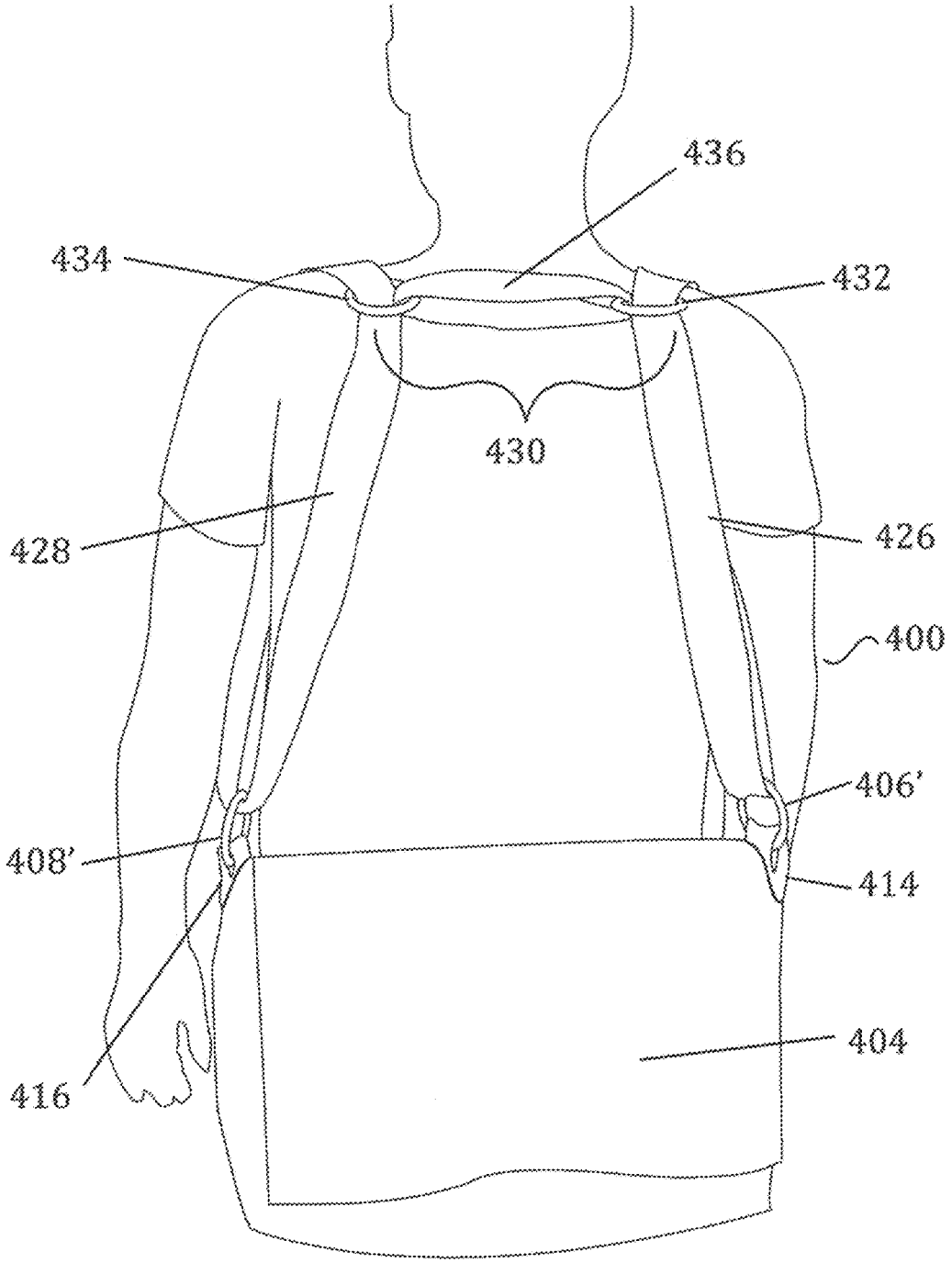

The illustrated rings 432 and 434 may be circular or other shaped rings and may have an internal opening dimension of about 1¾ inches. The strap 436 may be formed from leather having a width of about 1½ inches. The total length of the strap 436 may be between about 6 inches and 18 inches, for example, between about 8 inches and 12 inches. The straps 426 and 428 may be shortened in relation to the straps of FIGS. 2A-2B. For example, the straps 426 and 428 may be shortened such that the overall length of the strap system 404 of FIG. 4 is similar to the overall length of the strap system 202 of FIGS. 2A-2B.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A strap system for use in carrying packs, bags, and cases comprising: a strap assembly consisting of two or more loops of material, wherein each loop comprises a first and second end, said first and second ends being connected via an adjustment buckle or with ends sewn together; first and second attachment mechanisms, interconnected to said strap assembly, for attaching said strap assembly to said pack, bag, or case (heretofore jointly referred to as pack) at first and second pack attachment locations; and a linkage assembly, interconnected to said strap assembly between said first and second attachment assemblies, for allowing each loop to slide through the linkage assembly and allowing said strap assembly to be configured in at least first and second carrying modes, wherein;

in said first carrying mode, said strap assembly receives a first arm of a user and extends over a first shoulder of said user for single shoulder carrying such as a shoulder bag or cross-body carrying; and in said second carrying mode, the corresponding first and second strap loops of said strap assembly receive said first arm and a second arm of said user and extends over said first shoulder and a second shoulder of said user for two shoulder carrying;

said strap system being configured such that 1) said pack remains in an upright position in each of said first and second carrying modes, 2) said first and second attachment mechanisms and said linkage assembly remain continuously attached to said strap assembly throughout transitions between said first and second carrying modes, and 3) said transitions can be executed by manipulating only said strap assembly free from operating any other reconfiguration mechanism.

2. A strap system as set forth in claim 1, wherein each of said attachment mechanisms is interconnected to said strap assembly in a manner that allows the material of the strap assembly to freely slide relative to each of said mechanisms so as to transition between said first and second carrying modes.

3. A strap system as set forth in claim 1, wherein said first and second attachment locations are each disposed above a horizontal centerline of said pack when said pack is in said upright position.

4. A strap system as set forth in claim 1, wherein said first and second attachment locations are disposed at first and second upper corner areas of said pack.

5. A strap system as set forth in claim 1, wherein said linkage assembly is interconnected to said strap assembly in a manner that allows the material of said strap assembly to freely slide relative to said linkage assembly so as to transition between said first and second carrying modes.

6. A strap system as set forth in claim 1, wherein said linkage assembly comprises one or more loops of material.

7. A strap system as set forth in claim 6, wherein said loops of material comprise a first ring, a second ring, and a linkage strap configured as loop extending through each of said first and second rings.

8. A strap system as set forth in claim 1, wherein said first and second attachment mechanisms comprise respective first and second rings, said linkage assembly comprises a center ring, and said strap assembly comprises a first strap configured as a loop extending through said first ring and said center ring and a second strap configured as a loop extending through said second ring and said center ring.

9. A pack, comprising a pack body having at least one internal compartment assessable via an opening disposed at a top portion of said compartment when said pack is in an upright orientation;

a strap assembly consisting of two or more loops of material, wherein each loop comprises a first and second end, said first and second ends being connected via an adjustment buckle or with ends sewn together;

first and second attachment mechanisms, each comprising one or more loops of material, for attaching said respective first and second straps loops to said pack body at respective first and second attachment locations, each of said first and second straps loops being secured to said pack body at first and second securing points, at the same or different locations than said respective first and second attachment locations, said first and second securing points being disposed above a horizontal centerline of said pack body when said pack is in said upright orientation, said first and second securing points further being disposed on opposite sides of a vertical centerline of said pack body when said pack is in said upright orientation; and a linkage mechanism comprising one or more loops of material for interconnecting said first and second strap loops;

said first strap loop extending through said first attachment mechanism and said linkage mechanism and being freely moveable relative to said first attachment mechanism and said linkage mechanism so as to transition between first and second carrying modes; and said second strap loop extending through said second attachment mechanism and said linkage mechanism and being freely moveable relative to said second attachment mechanism and said linkage mechanism so as to transition between first and second carrying modes.

10. A pack as set forth in claim 9, wherein said first carrying mode comprises a single- arm carrying mode, wherein said first strap loop, said second strap loop, and said linkage mechanism define a strap assembly for receiving a first arm of a user and extending over a first shoulder of the user, wherein said pack is disposed in said upright orientation in said first carrying mode.

11. A pack as set forth in claim 10, wherein said second carrying mode comprises a two- arm carrying mode, wherein said first strap loop defines a first opening for receiving a first arm of said use such that said first strap loop extends over a first shoulder of said user, and said second strap loop defines a second opening for receiving a second arm of said user such that said second strap loop extends over a second shoulder of said user, wherein said pack is disposed in said upright orientation in said second carrying mode.

12. A pack as set forth in claim 9, wherein said first and second securing points are disposed at first and second upper corner areas of said pack.

13. A pack as set forth in claim 9, wherein each of said first linkage assembly, said second linkage assembly, and said linkage assembly comprises a metal ring.

14. A pack as set forth in claim 9, wherein each of said first and second strap loops is formed from one of leather, vinyl, or fabric.

* * * * *